US005461859A

United States Patent [19]

Beale et al.

[11] Patent Number: 5,461,859

[45] Date of Patent: Oct. 31, 1995

[54] CENTERING SYSTEM WITH ONE WAY VALVE FOR FREE PISTON MACHINE

[75] Inventors: William T. Beale; Neill W. Lane, both of Athens, Ohio; Jarlath McEntee, Castine, Me.

[73] Assignee: Sunpower, Inc., Athens, Ohio

[21] Appl. No.: 303,037

[22] Filed: Sep. 8, 1994

[51] Int. Cl.[6] ..... F01B 29/10

[52] U.S. Cl. ..... 60/517; 60/520

[58] Field of Search ..... 60/517, 520, 960; 92/181 P; 62/6

[56] References Cited

U.S. PATENT DOCUMENTS

| | | | |
|---|---|---|---|
| 4,183,214 | 1/1980 | Beale et al. | 60/520 |
| 4,404,802 | 9/1983 | Beale | 60/520 |
| 4,583,364 | 4/1986 | Wood | 60/520 |
| 4,945,726 | 8/1990 | Beale | 60/520 |

OTHER PUBLICATIONS

*Stirling Engines*, G. Walker, 1980. Oxford University Press, New York, pp. 116 and 117.

*Primary Examiner*—Stephen F. Husar

*Assistant Examiner*—Alfred Basichas

*Attorney, Agent, or Firm*—Frank H. Foster; Kremblas, Foster & Millard

[57] ABSTRACT

A piston centering system for a free piston machine. The invention uses a centering passageway which is in communication between a work space and a second space which spaces are formed in a housing and are separated by a piston which reciprocates in a cylinder in the housing. The centering passageway has a valve, such as a spool valve formed in the piston and cylinder or a center post, the valve opening in response to the piston being near the center of the opposite limits of its reciprocation. The improvement is the inclusion of a pressure responsive, one way valve interposed in the passageway. The one way valve is oriented to permit the passage of the working gas through the passageway from one space to the other in a direction opposite to a net leakage flow from one space to the other through the annular gap between the piston and cylinder and to prevent substantial flow through the passageway in the reverse direction.

11 Claims, 6 Drawing Sheets

CENTERING SYSTEM WITH ONE WAY VALVE FOR FREE PISTON MACHINE

TECHNICAL FIELD

The present invention relates to an apparatus for centering the power piston of a free piston machine, such as Stirling engine or heat pump, at a desired mean operating position. In one aspect it relates to a centering port system which periodically vents gas from the space at one end of the piston to the space at the other end of the piston, such as from the back space to the work space of a Stirling machine, but prevents the intentional venting of gas in the reverse direction.

BACKGROUND ART

A free piston Stirling machine typically comprises the components of a cylindrical housing containing a linearly reciprocating power piston and a linearly reciprocating displacer. The piston divides the interior of the housing into two gas spaces. One space is a work space bounded by the piston on the displacer side of the piston, and the other is a back space or bounce space bounded by the other side of the piston. Heat is supplied to the gas in the work space and together with the piston and displacer cooperates to cyclically compress and expand the gas therein to convert a portion of the supplied heat into work. The gas in the back space may act as a spring to limit the motion of the piston during the power stoke of the engine and to sustain the reciprocation of the piston and displacer in timed, although out of phase, relation. Heat is removed from the gas in the work space in an amount equal to the difference in the heat supplied and the work produced as required by the first and second laws of thermodynamics. A regenerator device is employed for regenerating some of the heat supplied from one cycle to the next. The working gas in the engine may be air, hydrogen, helium, other gases, vapors or liquids, or the like.

In a free piston Stirling engine, the power piston may be coupled to magnets which are reciprocated by the piston within alternator windings for converting the mechanical work produced by the engine into electrical energy. A principal advantage of this mode of operation is that the engine requires no external mechanical linkages with other equipment and, therefore, the entire engine may be hermetically sealed. This of course increases reliability and the lifetime of the engine.

While reference is made to a Stirling engine, the invention is equally applicable to other free piston Stirling machines such as heat pumps and refrigerators and to other free piston machines such as a free piston compressor. In such Stirling applications, the direction of the heat and work energy interactions are reversed. The term Stirling machine is intended to refer to Stirling engines, heat pumps, and refrigerators.

Sealing means are provided between the power piston and the inner wall of the housing for substantially sealing the work space from the back space. The sealing means may be in the form of rings or simply a precision fit. In either case, since the piston must be free to reciprocate in the housing, taking into account effects such as thermal expansion, a small annular gap unavoidably exists between the piston and the housing. The working gas may flow between the work and back spaces through the interposed annular gap with the direction of flow being from high to low pressure. The working gas, therefore, will leak from the work space to the back space when the work space pressure is higher than the back space pressure and in the reverse direction when the pressure difference is reversed. The flow through the annular gap is a nonlinear function of the flow rate being proportional to the square of the pressure difference across the gap or some other nonlinear relation.

The back space in Stirling machines is generally designed to have a relatively large volume and, consequently, the pressure of the gas in the back space remains approximately constant during operation. The pressure in the work space, however, undergoes large amplitude changes over the cycle. The work space pressure, when viewed as a function of time, appears as a pressure wave having a series of peaks which rise rapidly above the back space pressure. The peaks are followed by a longer interval of time wherein the work space pressure is slightly below the back space pressure until the next peak occurs. The pressure wave increases and decreases in asymmetric relation to the back space pressure. Although the peaks in the pressure wave last for only a short period of time in relation to the overall period of the cycle, there is a strong potential for gas to leak from the work space to the back space (outward) due to the nonlinearity of the pressure and flow rate relationship. For the interval of time following the peak where the back space pressure is higher than the work space, the flow will be in the opposite direction (inward), however, due to the nonlinear flow the gas flow rate during this interval will be substantially less than during the peak. Over the period of the cycle some of the flow is inward and some of the flow is outward, however, the usual effect of the nonlinearity of the flow is a net transfer of gas from the work space to the back space. This or any other cause of asymmetric leak increases the volume of gas in the back space and decreases the volume of gas in the work space which causes the piston to creep inward from its design mean position.

Imperfections in the piston and housing fit may cause the piston to creep outwardly. However, in a precisely formed engine the nonlinear relation between pressure and flow generally gives rise to an inward creep. Creep in either direction makes it difficult to control the piston position and may degrade engine performance. In other free piston machines a different asymmetrical pressure wave in the work space can also cause inward or outward creep.

Most approaches for automatically centering the piston of a free piston Stirling machine have involved a gas porting system for periodically returning the asymmetrically leaked gas from the back space to the work space. For example, U.S. Pat. No. 4,583,364 teaches a method and apparatus comprising a center port and passageway which is periodically opened by the power piston, thereby permitting a corrective inward flow of gas to balance the outward asymmetric leak. That patent further teaches the use of a displacer having a sealing surface which periodically registers with a port along the passageway to block the outward flow of gas on the piston return (outward) stroke. Prohibiting the flow of gas during the outward stroke improves power output since there will be no gas transfer from the work space to the back space as would otherwise occur.

U.S. Pat. No. 4,404,802 teaches the use of a centering port system which is opened and closed by ports forming a spool valve coming into registry. The work space and back space are brought into fluid communication during both the inward and outward strokes of the piston so that there is gas flow through the centering port system in both directions. In this mode, both inward and outward creep are balanced. That patent does not contemplate a one way centering port. Centering port systems of the type described are generally formed in a portion of the cylinder part of housing and may also include passageways and ports in the piston. They also include a valve linked to the piston which opens at or near the design mean piston operating position. Typically, the valve is formed to interrupt flow in the centering passageway and is a spool valve arrangement in which the piston functions as the spool which covers and uncovers one or more ports in the cylinder or central post to connect the work space and the second space in communication when the piston is near its center position.

Therefore, in summary, in a free piston Stirling cycle machine, an asymmetric pressure wave in the work space causes a problem of keeping the piston centered as a result of a preferential leak from or to the working space to the back space behind the piston. This results in a creep of the average piston position away from its desired center position as a result of a migration of some fluid mass from one space to the other. A conventional method to prevent this inward creep is to allow a communication between work and back spaces through ports in the equivalent of a spool valve mounted on or connected to the piston which come into coincidence at the center of the stroke, so that a flow of fluid can result between the two spaces and allow the average mass in the two spaces to remain fixed and thus the piston to remain centered. This is the accepted way to keep the piston centered, however a power loss penalty accrues from the fact that gas flows both in and out at each passage of the piston both on its in and out passage by the center port.

BRIEF DISCLOSURE OF INVENTION

A method found to be efficacious is to put a check valve on the center port so that the flow can only take place one way-toward the space which is tending to loose mass. This eliminates the in and out flow and the consequent power loss. The only centering flow is that necessary to overcome the net in or out flow, allowing a very large port to be used which is robust in its centering action with minimal loss. In theory this port can be of any size, since its only action is to allow the flow needed to counteract the system asymmetrical leakage, and the redundant leakage on the return passage by the port is eliminated. In addition, the placement of the check valve on the surface nearest the working space eliminates the dead volume associated with the centerports, and this again reduces thermodynamic losses associated with expansion and compression of this unnecessary volume.

The present invention is an improved one way centering port apparatus for centering the piston of a free piston machine, such as Stirling machines used as engines, heat pumps, and refrigerators. The present invention uses a centering port system which periodically interconnects the back space and work space for effecting a corrective flow of gas therebetween. The flow balances the nonuniform leakage of gas arising from the asymmetric work space pressure variation and the nonlinear pressure and flow relationship whereby the power piston remains centered.

The invention uses a centering passageway which is in communication between the work space and a second space, such as a backspace, and which has a valve, such as a spool valve formed in the piston, for opening in response to the piston being near the center of the opposite limits of its reciprocation. The improvement is a pressure responsive, one way valve interposed in the passageway and oriented to permit the passage of the working gas between the spaces in a direction opposite to the net leakage flow through the annular spaces between the piston and cylinder and to prevent substantial flow in the reverse direction.

The one way action, which is not dependent upon displacer position or structure, significantly improves power output by reducing power loss. Power loss is reduced by preventing the unnecessary transfer of gas from the work space to the back space during the outward stroke as would occur if the unnecessary flow through the centering system was not checked. The present one way valve also permits the use of a larger centering port and passageway which provides a transfer of gas with less flow resistance and a faster response which in turn results in a more reliable and more precise centering action .

A principal objective of the present invention is to provide a reliable, low cost one way centering system for centering the power piston of a free piston Stirling machine or the piston of other free piston machines. The overall reliability of the engine is improved since the piston centering is more reliably maintained between closer tolerance limits with a faster response. It also simplifies the control of the piston position by an external controller if such is used.

Figure 1:
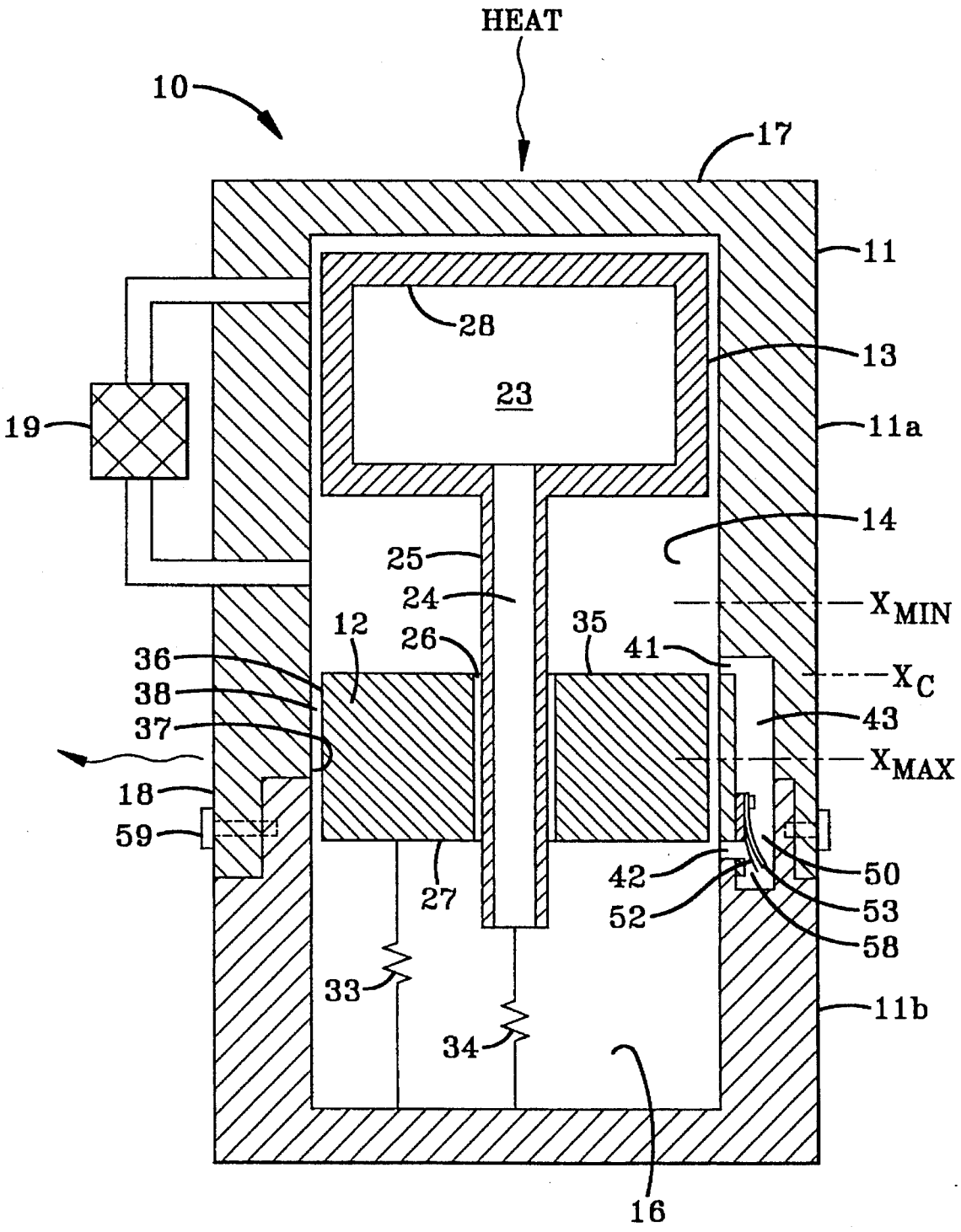
FIG. 1 is a diagrammatic sectional view of a free piston Stirling engine provided with the one way centering port system of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Referring to FIG. 1, free piston Stirling engine 10 comprises housing 11, reciprocating power piston 12, and reciprocating displacer 13. Piston 12 bounds the work space 14 and in combination with the interior of housing 11 defines work space 14 on the displacer side of the piston. The opposite end of the piston similarly bounds the back space 16. The work space and back space contain the same working gas which may be air, hydrogen, helium or other fluids. For driving the engine, heat is supplied to the hot end 17 of the work space and removed from the cool end 18. The flow of heat combined with the reciprocation of the displacer induces the gas in the work space to alternatingly expand and contract whereby piston 12 and displacer 13 reciprocate in housing 11 for producing mechanical work according to well known thermodynamic principles of the prior art. As is also well known in the art, Stirling engine 10 is provided with a regenerator 19 which acts to regenerate heat in the engine from one cycle to the next. The motion of power piston 12 towards work space 14 is referred to as inward motion, while piston motion toward back space 16 is referred to as outward motion. In a preferred mode of the prior art, piston 12 is mechanically coupled to a magnet (not shown) which is reciprocated in an electrical alternator apparatus for converting the mechanical work produced by the piston into electrical energy for any number of uses.

Figure 2:
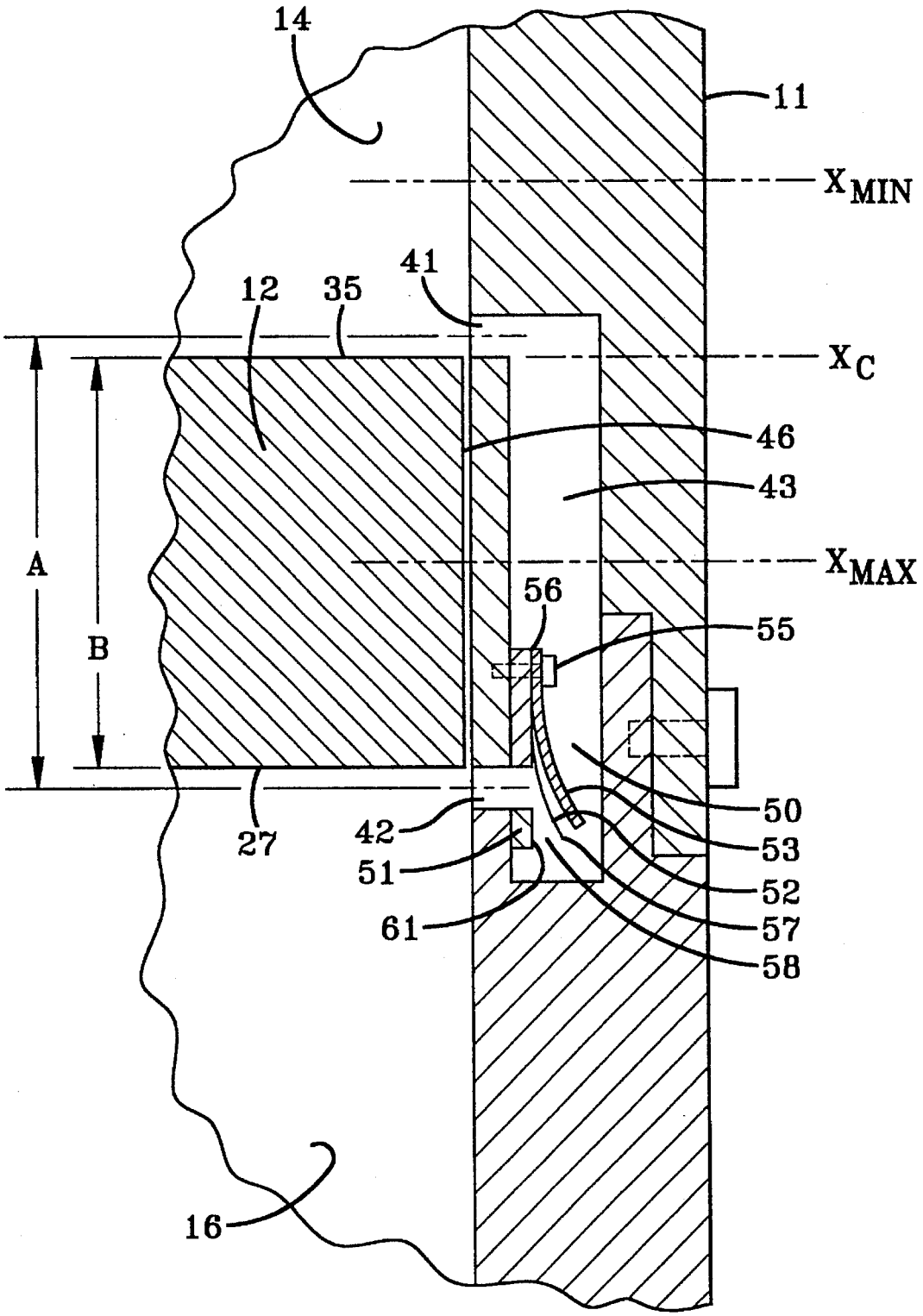
FIG. 2 is diagrammatic sectional view illustrating a check valve of the present one way centering port system.

Displacer 13 has formed therein an inner chamber 23 in fluid communication with back space 16 through conduit 24 formed in displacer rod 25. However, the use of an inner chamber in communication with the backspace is not necessary. Displacer rod 25 passes slidingly through piston 12 through a central hole 26 in the piston. During operation, the gas in back space 16 exerts a pressure on the outward surface 27 of piston 12 and on the inner surface 28 of displacer 13 whereby the gas acts as a spring for sustaining the reciprocating motion of the piston and displacer in timed relation. For this reason back space 16 is often referred to alternatively as the bounce space. Power piston 12 and displacer 13 may also be provided with mechanical springs 33 and 34, respectively, for resonating the piston at the desired frequency of reciprocation. Referring to FIGS. 1 and 2, the minimum inward position of piston 12 is labeled in $X_{MIN}$ and the maximum outward position is labeled $X_{MAX}$, the positions being measured at the inward surface 35 of the piston. The designed mean position of the piston is labeled $X_C$.

Exterior wall 36 of reciprocating piston 12 is sized to have a precision fit within the cylinder defined by interior wall 37 of housing 11. A precision fit which permits sliding reciprocation requires an annular gap 38 therebetween. Although not shown, piston 12 is preferably provided with gas bearing means which provides a thin layer of pressurized gas in gap 38 for lubrication. While the dimensions will vary from one size machine to another, for a 5 kW rated engine, the gap width of gap 38 is preferably between 20 to 30 microns. Similarly displacer 13 is provided with gas bearing means for lubricating the displacer motion in the housing, as well as gas bearing means between displacer rod 25 and piston hole 26. Alternative lubrication means are possible as is known to those of skill in the art.

Figure 3:
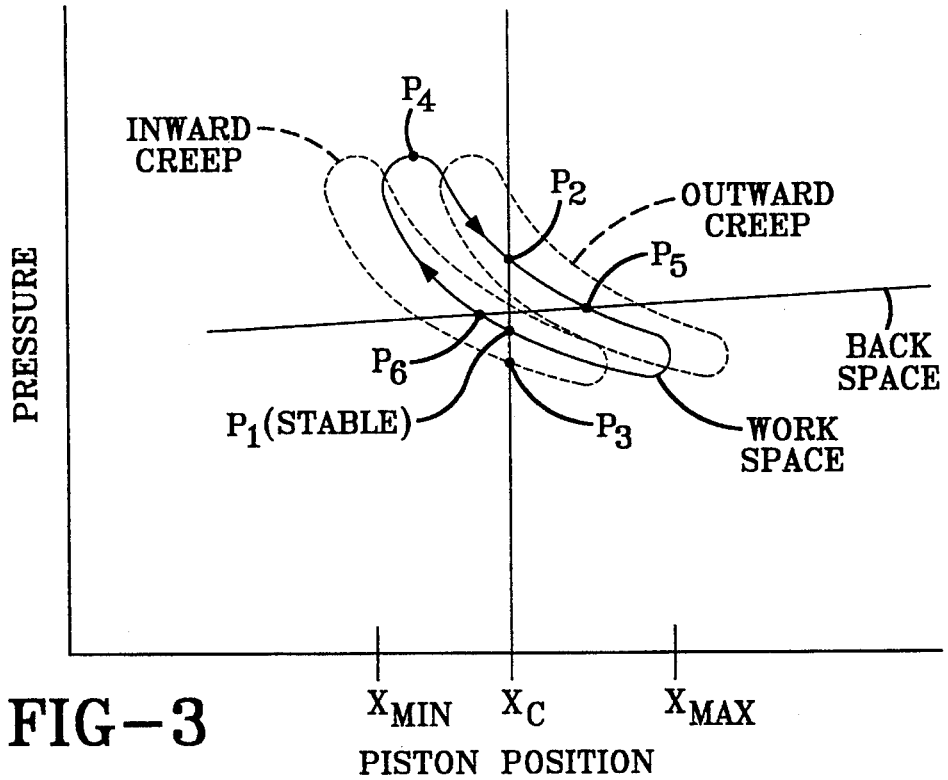
FIG. 3 is a graphical illustration of the variation of the work space and back space pressure as a function of piston position.

FIG. 3 illustrates graphically the variation in the work space and back space pressures as a function of piston position during the engine cycle. Since the back space is typically designed to have a volume significantly larger than the work space, the back space pressure remains approximately constant over the cycle. The work space pressure, however, is seen to undergo large variations over the cycle with the peak pressure occurring at point $P_4$. Points $P_5$ and $P_6$ represent the points in the cycle where the work space pressure and back space pressure are equal. As described in relation to FIG. 1 the desired mean piston operating position is labeled as $X_C$ while the design limits of reciprocation are labeled $X_{MIN}$ and $X_{MAX}$.

Figure 4:
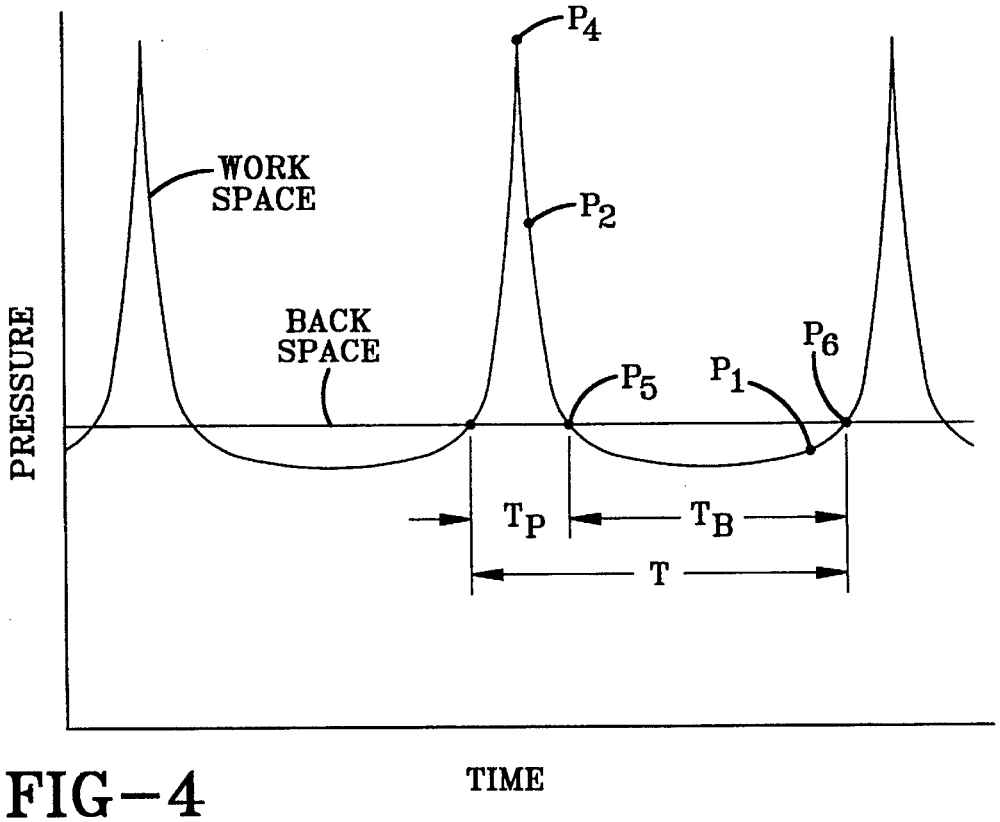
FIG. 4 is a graphical illustration of the work space pressure as a function of time.

FIG. 4 illustrates the work and back space pressures as a function time wherein it is seen that the work space pressure comprises a peak-type waveform having a period T. The pressure wave further comprises subintervals $T_P$ having peak $P_4$, and subinterval $T_B$ wherein the work space pressure is slightly lower than the back space pressure, the interval $T_P$ being shorter in duration than $T_B$. During interval $T_P$ the working gas will flow from the work space to the back space (outward) through annular gap 38 whereas during interval $T_B$ the flow direction will be reversed (inward) according to the well known principle of a gas tending to flow from high to low pressure. The flow through annular gap 38 is nonlinear with the flow rate being proportional to the square of the pressure difference across the gap. Therefore, during the interval $T_P$ there is a nonlinear second order effect which creates a much stronger driving potential for outward flow than exists during interval $T_B$ for flow in the reverse direction. Although interval $T_P$ is shorter in duration than interval $T_B$, and although gas flows in both directions over the engine cycle, the nonlinear flow effect results in a net asymmetric leak of gas outward. The net leakage flow resulting from the asymmetry of the leakage increases the mass of gas in the back space and decreases the mass of gas in the work space which together cause the piston to creep inwardly. The inward creep is represented on the cycle diagram of FIG. 3 by a broken line. It is a principal object of the present invention to provide a one way valve which reduces power loss while permitting the centering system to automatically and more precisely maintain the mean position of piston 12 at $X_C$ thereby giving precise control of the piston position.

Referring to FIGS. 1 and 2, the cylinder of housing 11 is provided with centering port 41 opening into work space 14 and centering port 42 opening into back space 16. Centering ports 41 and 42 are interconnected through a flow passageway 43 formed in the housing. The distance between the centerlines of ports 41 and 42 is (designated as dimension A in FIG. 2) is preferably but not necessarily slightly larger than the height of piston 12 (designated as dimension B in FIG. 2). The port 41 and 42 must be spaced far enough apart so that as the piston moves along its stroke, both ports will be uncovered (open) for an interval of time while piston 12 is between the ports. As seen in FIG. 3, this will occur at two points in the cycle at which piston 12 is located at the mean position, $X_C$, indicated by points $P_1$ and $P_2$. The point $P_1$ corresponds to the inwardly moving portion of the piston stroke and point $P_2$ corresponds to the outwardly moving portion of the piston stroke. In conventional centering ports wherein no means are employed to control the centering port flow in any particular direction, fluid would flow between work space 14 and back space 16 (via ports 41 and 42) as a function of the pressure differential which exists between the two spaces when the ports 41 and 42 are uncovered by the piston.

Referring to FIG. 3, at $P_1$ the back space pressure is slightly higher than the work space pressure and therefore fluid will tend to flow from back space 16, into port 42, through passage 43, through port 41, and into work space 14. This may occur at a distance of, for example, 0.1 mm before point $P_6$ at which the pressure of the back space and the work space are equal. Because piston 12 is moving inward very rapidly at the position $P_1$, the ports 41 and 42 will be open for only a short period of time while the piston is between the ports allowing for a brief transfer of gas through the ports. This brief flow of gas counterbalances the asymmetric leakage of gas outward through annular gap 38 as has been described, so that the volume of gas in each space is the same at the end of each cycle as at the beginning of the cycle, whereby the piston remains centered. As piston 12 continues its inward stroke from point $P_1$, piston surface 46 (see FIG. 2) covers port 41, and due to the precision fit of the piston in the housing, surface 46 establishes a substantial seal of port 41 in the manner of a spool valve and the flow through the centering port is discontinued. Because the piston height B is larger than the distance between $X_C$ and $X_{MIN}$, once port 41 has been closed by piston surface 46 it remains closed for the duration of the inward stroke which ends at $X_{MIN}$, as well as the initial part of the ensuing outward stroke until piston 12 again becomes approximately centered between ports 41 and 42.

Referring to FIG. 3, at point $P_1$ the pressure difference between the work space and the back space is small and thus the loss of power which occurs by opening the ports at $P_1$ is small. Furthermore, since a small pressure differential must exist to drive the flow of gas from the back space to the work space, point $P_1$ is a stable piston operating point for the engine. The small pressure differential between the back space and the work space at $P_1$ provides the correct amount of flow driving potential to just balance the outward leak.

Centering ports 41 and 42 are opened a second time in the cycle at point $P_2$ on the piston outward stroke. It is seen in FIGS. 3 and 4 that at $P_2$ the pressure in the work space is significantly higher than the back space pressure and opening of ports 41 and 42 in a conventional centering system would cause a significant amount of fluid to flow from the work space to the back space. This flow would cause an energy loss resulting from the transfer of working fluid mass from the work space to the back space, referred to as a throttling loss, and the result would be a loss in power output. Piston 12 continues outwardly from $P_2$ whereby surface 46 covers port 42 for discontinuing any flow of gas through the port. Port 42 remains closed for the duration of the outward stroke which terminates at $X_{MAX}$. It is desirable for the passageway through the ports 41 and 42 to be opened during the piston inward stroke for centering the piston, however, it is desirable that the passageway through the ports be closed during the outward stroke for improving power output.

In the past, centering ports of small diameter have been used to limit the flow of gas during the outward stroke in order to reduce the undesired throttling loss. This of course also limited the desired centering flow of gas during the inward stroke which reduced the effectiveness of the centering port system. It is more desirable to have a large and rapid transfer of gas during the inward stroke to provide a higher mass transfer rate compensating for the net leakage past the piston and quickly bringing the net flow between the two spaces from all causes into stable equilibrium. The present invention permits passageway and port diameters which are three or four times larger than have conventionally been used for centering systems and thereby greatly reduces or eliminates the instability apparent as wandering in the prior are systems. It is also desirable to prevent flow during the outward stroke to prevent the throttle loss and also because flow through the centering system in the same direction as the net leakage represents additional leakage in addition to the leakage between the piston and cylinder which must be compensated for by the centering system during the inward stroke.

For providing robust centering action of the piston, as well as one way flow through the ports to eliminate gas flow during the piston outward stroke, the passageway connected to centering port 42 is provided with one way check valve assembly 50. The prior art is familiar with a variety of one way valves often referred to as check valves or fluid diodes. As known to those skilled in the art, a one way valve is a pressure responsive valve which has a high resistance to fluid flow in one direction, ideally infinite, and a low resistance to fluid flow in the opposite direction, ideally zero. The present invention can use any of the variety of one way valves which are presently or in the future become known. However, for purposes of illustration the following valve is described.

Check valve 50 comprises mounting member 51 having secured thereto flexible sealing member 52, and restraining member 53. Valve 50 may be secured to housing 11 by bolt 55. Bolt 55 passes through restraining member 53, flex member 52 and mounting member 51 and acts to clamp the three components together at one end of the valve assembly. For installing and or removing valve 50, housing 11 may be formed in substantially two halves 11*a* and 11*b* which may be joined using bolts 59. Separating halves 11*a* and 11*b* provides access to the valve. Other methods for providing access to valve 50 are possible as would be apparent to those of ordinary skill in the pertinent art.

Mounting member 51 and restraining member 53 are rigid members preferably constructed from metal such as high quality steel. Flex member 52 is a reed-type of member and is clamped between members 51 and 53 at valve end 56. Distal end 57 of flex member 52, however, is flexible and is free to deform in the proximate space between mounting member 51 and restraining member 53. Member 53 acts to limit the amplitude of deformation so that flex member 52 will remain within its elastic deformation regime to ensure the flex member will not be damaged by excessive and/or plastic deformation. Flex member 52 is preferably constructed from a flat piece of flexible material having a thickness of between 50 to 150 microns.

The pressure differential between work space 14 and back space 16 determines whether valve 50 is opened or closed by determining the position of flex member 52. Referring again to FIG. 3, at $P_1$ it is seen that the back space pressure is higher than the work space pressure. In this instance the force exerted on flex member 52 by the gas in back space 16 is larger than the force exerted on the flex member by the gas in the work space (acting through port 41 and passage 43). The net force on flex member 52 is thus from the back space to the work space. The net force causes end 57 of the flex member to flex in this direction thereby creating opening 58 whereupon gas in back space 16 may flow into port 42, through opening 58, into passage 43 through port 41, and into work space 14

In the case where the pressure in the work space is higher than the pressure in the back space as at point $P_2$, the net force on flex member 52 by the working gas acts from the work space to the back space causing the member to seat onto sealing surface 61 of mounting member 51, thereby closing opening 58 (closed position shown as broken line in FIG. 2). In the closed position, a fluid seal is established between flex member 52 and surface 61 and there will be no flow of gas from the work space to the back space as would otherwise occur in the absence of one way valve 50. The greater the pressure differential between work space 14 and back space 16, the harder flex member 52 will be pressed onto sealing surface 61, thereby improving the sealing action. As has been stated, the one way action significantly improves power output by avoiding undesired outward flow from the work space during the outward stroke during which valve 50 is in the closed position.

From the above it can be seen that there are two conditions which must be met for gas to flow between the back space and the work space through the present centering apparatus. The first is that piston 12 be disposed between center ports 41 and 42 thereby uncovering (opening) the ports. If this condition is not met, piston surface 46 will cover and close either port 41 or port 42 depending on whether the piston is inward or outward, respectively, as has been described. The second condition is that the back space pressure must be higher than the work space pressure for inducing flex member 52 to unseat from sealing surface 61 for opening flow opening 58. If the second condition is not met (i.e. the pressure in the work space is higher than that in the back space), flex member 52 of valve 50 will be induced to seat onto sealing surface 61 thereby closing flow opening 58. Therefore, it can be seen that at point $P_1$ both conditions are met and one way valve 50 allows a corrective flow of gas from back space 16 to work space 14 which acts to center piston 12 by compensating for the asymmetrical leaking through annular gap 38 as has been described. At point $P_2$, however, while the first condition is met the second condition is not and thus there will be no flow of gas from the work space to the back space thereby eliminating the attendant loss of power as has been described above.

The present one way centering port system provides automatic centering action as the piston creeps in or out from the center position at $X_C$. In the event the piston creeps outwardly, the asymmetric leakage outwardly between the piston and cylinder will act to return the piston to the center position. In the event the piston creeps inwardly as illustrated by broken line in FIG. 3, stable valve opening point $P_1$ moves to $P_3$, where the pressure differential between spaces 14 and 16 is increased. The increased pressure difference will create an increased corrective flow inward as valve 50 is opened thereby inducing piston 12 to move outward towards stable center point $P_1$.

Although flex member 52 is a very flexible member, its motion is constrained between mounting member 51 and restraining member 53. Restraining member 53 is positioned to limit the motion of flex member 52 within its elastic deformation regime in the case where the valve is fully open. In the case where the valve is fully closed (i.e. work space pressure higher than back space pressure) flex member 52 has sufficient strength so it will not be blown out through port 42. In addition, in the closed position flex member 52 is principally loaded in shear whereas in the open position it is loaded in bending.

Importantly, the use of the one way valve of the present invention has the advantage that relatively large flow ports 41 and 42 and flow passage 43 may be used which provide very robust centering capability by providing rapid and relatively unrestricted transfer of gas from the back space to the work space. By providing a larger passageway and ports, less work is required and therefore wasted in forcing the fluid through the centering system. With the present invention, ports and passageways having a minimum or least diameter which is substantially equal to or greater than 3% of the piston diameter may be utilized. Ports and passageways of that size would be considered very big and unacceptably lossy with conventional centering systems. Because passageways and ports are not necessarily circular in cross-section, it may equivalently be stated that the least cross-sectional area of the passageway, including its ports, may be at least 0.09% of the cross-sectional area of the piston.

Figure 5:
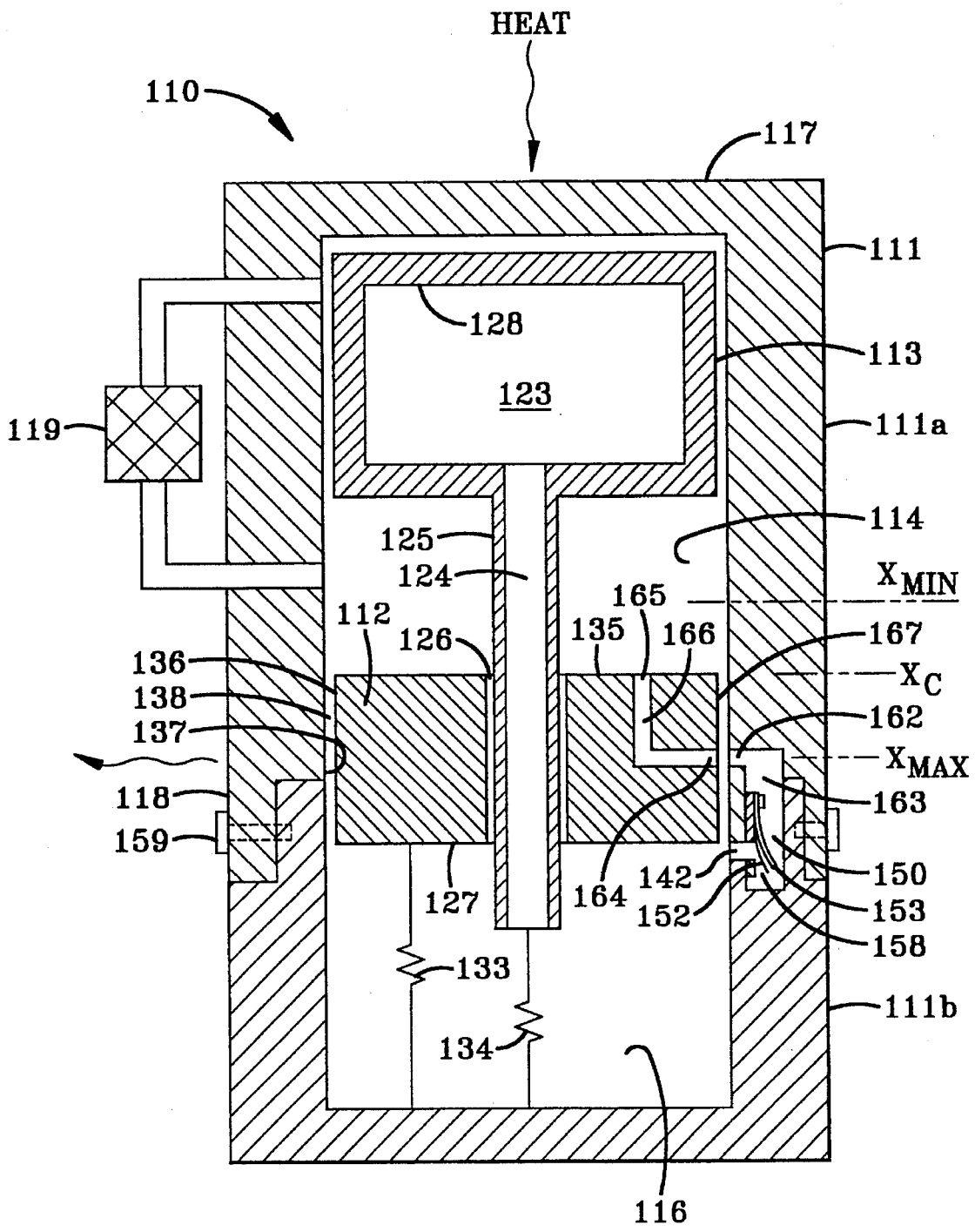
FIG. 5 is a diagrammatic sectional view of a free piston Stirling engine comprising a flow port and a portion of the passageway in the power piston.

FIG. 5 illustrates an alternative preferred embodiment of the present invention wherein the centering port 142 in back space 116 is in fluid communication with port 162 through flow passage 163. Piston 112 is provided with port 164 in fluid communication with work space 114 through internal flow passageway 166 and port 165. Piston port 164 comes into registry with port 162 at or near the piston center position $X_C$ thereby establishing a fluid conduit between back space 116 and work space 114. At the point of registry, the gas pressure in work space 114 is substantially transmitted through passages 166 and 163 (across ports 164 and 162) to act upon valve 150. During the piston inward stroke the pressure in space 16 is higher than space 14 whereby flex member 153 deflects to form flow opening 158 as has been described in relation to FIGS. 1 and 2. An inward corrective volume of gas will flow from space 116 through port 142, passageway 163, port 162, port 164, and passageway 166 to be discharged into space 114 through port 165. On the outward piston stroke, piston port 164 will again register with port 162, however, the high pressure in space 114 will induce flex member 153 to seat onto sealing surface 161 thereby prohibiting outward flow and the associated power loss. As the piston is disposed inward or outward, sealing surface 167 of the piston will block port 162 and there will be no flow between spaces 116 and 114. As an alternative which is preferred, the one way valve may be positioned at the port 65 in the same manner as the valve 234 shown in FIG. 6.

Figure 7:
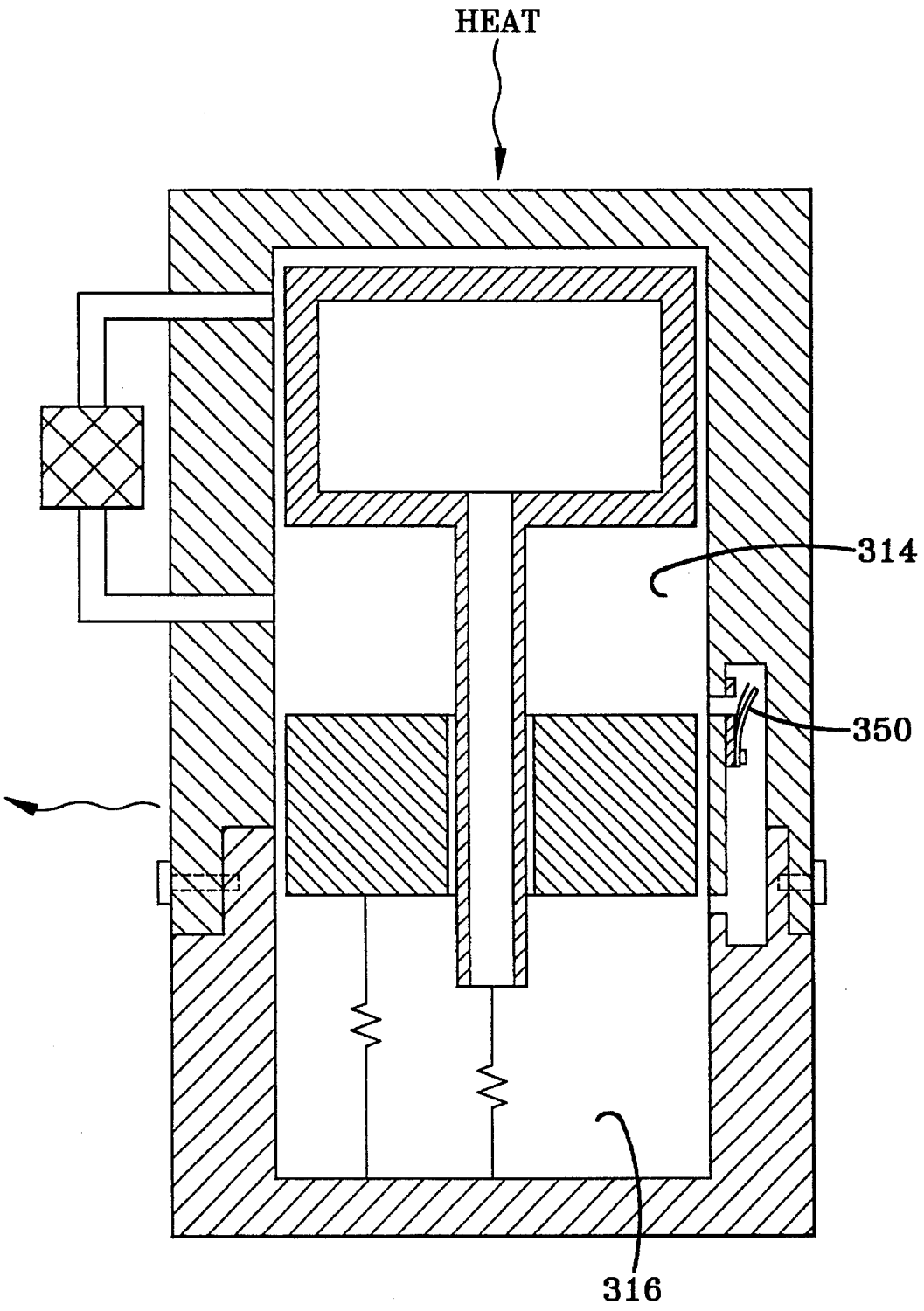
FIG. 7 is a diagrammatic sectional view of a free piston Stirling engine similar to the embodiment of FIG. 1, but having the one way valve oriented to permit the passage of the working gas from the work space to the second space.

From the above embodiments of FIGS. 1 and 5 it is seen that a number of passageway configurations for periodically interconnecting the work space and back space are possible without departing form the inventive concept of the present invention which comprises a one way valve disposed in the passageway between the spaces for permitting a corrective flow of gas in a preferred direction when the piston is near its center of reciprocation. The preferred direction for a free piston engine will usually be inward and will be effected during the inward stroke of the piston FIG. 7 illustrates an alternative embodiment in which the direction of corrective gas flow is outward. The one way valve 350, which is structurally similar to the one way valve 50 of FIG. 1, is oriented to permit the passage of the working gas from the work space 314 to the back space or second space 316.

Figure 6:
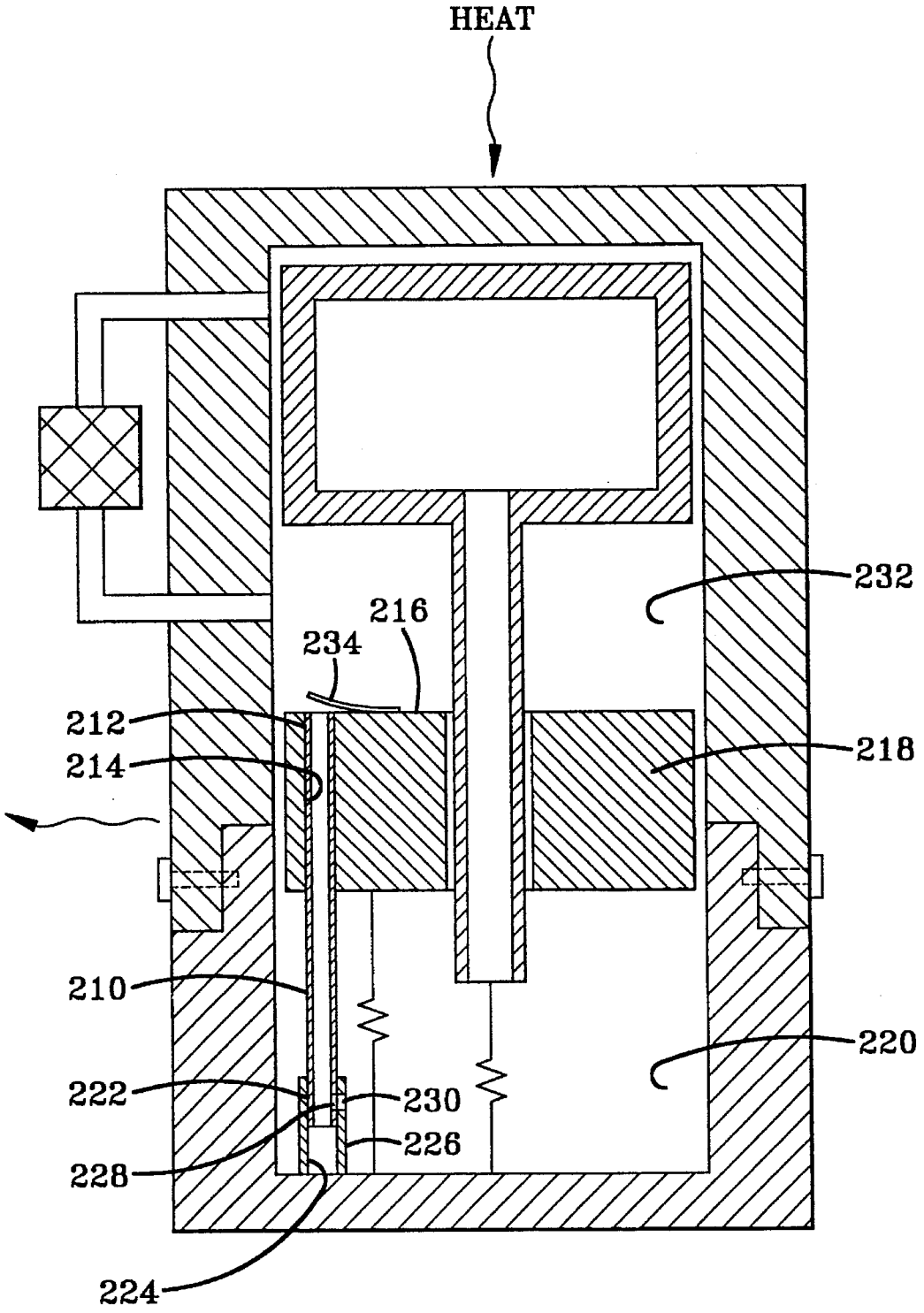
FIG. 6 is a diagrammatic sectional view of a preferred embodiment of the invention.

FIG. 6 illustrates a Stirling machine similar to that illustrated in FIG. 5, but containing a different embodiment of the invention. A hollow tube 210 is attached at its proximal end 212 to a mating bore 214 formed into the first end 216 of the piston 218 and extending entirely through the piston 218. The tube further extends from the piston 218 into the second space 220 and into sliding engagement at the tube's distal end 222 with a mating bore 224 in a valve body 226. The valve body and the tube together form a spool valve having ports 228 in the tube and 230 in the valve body. These ports come into registration when the tube is near the center of the opposite limits of the piston's reciprocation. Together the piston bore, the hollow passageway in the tube, and the slide valve ports form the passageway and valve for centering the piston by opening the spool valve when the piston is near its center position to allow passage of fluid between the second space 220 and the working space 232.

A one way valve is formed by a flexible sealing member 234 which is mounted at the first end 216 of the piston 218 adjacent the bore 214 through the piston.

It is particularly advantageous to position the one way valve at the work space end of the centering system passageway. This avoids the hysteresis loss in the passageway volume of the center porting system which otherwise inherently occurs in an alternately compressed and expanded fluid. For example, the embodiment of FIG. 6 has the flexible sealing member 234 at the very end of the passageway.

The present invention is not intended to be limited by the specific embodiments described herein as there are other one way valve designs which may be adapted without departing from the inventive concept disclosed herein. Although the present invention has been described as adapted to free piston Stirling engines, it is equally applicable to other Stirling machines used as heat pumps and refrigerators and to other free piston machines as would be understood by one of ordinary skill in the art.

While the present free piston Stirling machine has been described above in terms of a machine having a piston and a displacer which reciprocate within the same housing structure 11, it is well known that there are numerous other possible alternative yet equivalent configurations as evidenced by a number of treatises and texts on the subject (cf. Stirling Engines, by G. Walker, Oxford University Press, 1980). For example, it is well known in the art that the piston and displacer may be housed in two substantially different cylinders which are fluidally interconnected The present invention contemplates any of these well known alternative yet equivalent configurations.

While certain preferred embodiments of the present invention have been disclosed in detail, it is to be understood that various modifications may be adopted without departing from the spirit of the invention or scope of the following claims.

We claim:

1. An improved piston centering apparatus for a free piston machine having a housing including a cylinder and a piston sealingly reciprocatable in the cylinder, the housing enclosing a work space bounded by a first end of the piston and also enclosing a second space bounded by the opposite end of the piston, both spaces containing a working gas, the pressure in the second space having an average pressure and the pressure in the work space varying periodically in opposite directions from said average pressure, said pressure variation being asymmetric and thereby causing a net leakage flow of working gas from one of the spaces to the other through the clearance between the piston and the cylinder, wherein the improvement comprises the combination of:

(a) a passageway in communication between the work space and the second space and having a piston position responsive valve linked to the piston for opening in response to the piston being near the center of the opposite limits of piston reciprocation; and (b) a pressure responsive, one way valve connected to the passageway and oriented to permit the passage of working gas between the spaces in a direction opposite to said net leakage flow and to prevent substantial flow in the reverse direction.

2. A piston centering apparatus in accordance with claim 1 wherein at least a portion of the passageway extends through the cylinder and wherein the piston position responsive valve is a spool valve formed by the piston and cylinder and having at least one port in the cylinder which is, at times, covered by said piston to close said position responsive valve.

3. A piston centering apparatus in accordance with claim 2 wherein the one way valve is oriented to permit the passage of the working gas from the second space to the work space.

4. A piston centering apparatus in accordance with claim 3 wherein the passageway extends through the cylinder between two ports which are separated by at least substantially the distance between the ends of the piston.

5. A piston centering apparatus in accordance with claim 2 wherein the one way valve is oriented to permit the passage of the working gas from the work space to the second space.

6. A piston centering apparatus in accordance with claim 5 wherein the passageway extends through the cylinder between two ports which are separated by at least substantially the distance between the ends of the piston.

7. A piston centering apparatus in accordance with claim 1 wherein a hollow tube is attached at a proximal end of the tube to a mating bore formed into said first end of the piston and extends from the piston into the second space and into sliding engagement at a distal end of the tube with a mating bore in a valve body, the valve body and the tube forming a spool valve having ports which come into registration when the piston is near the center of the opposite limits of the piston's reciprocation, the piston bore, the hollow tube and the slide valve ports forming said passageway and said piston position responsive.

8. A piston centering apparatus in accordance with claim 7 wherein the one way valve is positioned substantially at said first end of the piston.

9. A piston centering apparatus in accordance with claim 8 wherein the one way valve is formed with a flexible sealing member mounted at said first end of the piston adjacent said bore in the piston.

10. A piston centering apparatus in accordance with claim 1 wherein said one way valve is positioned substantially at the work space end of said passageway.

11. A piston centering apparatus in accordance with claim 1 wherein the least cross-sectional area of the passageway is at least substantially 0.09 percent of the cross-sectional area of the piston.

* * * * *